United States Patent [19]

Jaton

[11] Patent Number: 4,656,815

[45] Date of Patent: Apr. 14, 1987

[54] METHOD AND DEVICE FOR CONTROLLING THE FILLING OF A CONTAINER

[75] Inventor: Jean-Philippe Jaton, Lausanne, Switzerland

[73] Assignee: Bobst SA, Switzerland

[21] Appl. No.: 770,794

[22] Filed: Aug. 29, 1985

[30] Foreign Application Priority Data

Aug. 31, 1984 [CH] Switzerland ..... 4174/84

[51] Int. Cl.[4] ..... B65B 5/10

[52] U.S. Cl. ..... 53/475; 53/58; 53/244; 53/251; 53/259; 271/119; 271/150; 271/214

[58] Field of Search ..... 53/55, 58, 244, 249, 53/251, 259, 475, 493, 534, 74, 500; 271/119, 129, 149, 150, 151, 213–215

[56] References Cited

U.S. PATENT DOCUMENTS

| | | | |
|---|---|---|---|
| 3,097,460 | 7/1963 | O'Brien | 53/244 X |
| 3,425,184 | 2/1969 | Heliot | 53/244 X |
| 3,743,114 | 7/1973 | Van Linder et al. | 271/119 X |
| 4,161,095 | 7/1979 | Buday | 53/244 X |
| 4,237,677 | 12/1980 | Klapp | 53/534 X |
| 4,240,539 | 12/1980 | Klapp | 271/151 X |
| 4,241,559 | 12/1980 | Klapp . | |
| 4,332,124 | 6/1982 | Jaton . | |
| 4,355,799 | 10/1982 | Bartizal | 271/151 |
| 4,361,318 | 11/1982 | Stobb | 271/215 X |

FOREIGN PATENT DOCUMENTS

| | | | |
|---|---|---|---|
| 2341508 | 9/1977 | France . | |
| 0053467 | 4/1979 | Japan | 271/151 |
| 630860 | 7/1982 | Switzerland . | |

*Primary Examiner*—John Sipos
*Assistant Examiner*—Steven P. Weihrouch

[57] ABSTRACT

A method and device fills sheet-like blanks, such as folded box blanks, into a container on the edge of the blanks to form a stack or row therein. The method and device utilizes a feed unit for removing blanks from a flow of shingled blanks one at a time and inserting them into a conveyor which transports them to a filling unit that inserts them one at a time on edge in a row or stack in the container. The device includes a control arrangement including various sensors, one for determining the presence of blank at the filling unit, one for detecting of the position of a surface on which the blanks are being placed and one for determining a position of a side wall of the container.

13 Claims, 8 Drawing Figures

METHOD AND DEVICE FOR CONTROLLING THE FILLING OF A CONTAINER

BACKGROUND OF THE INVENTION

The present invention is directed to a device and method for controlling the filling of a container with flat elements like folded box blanks which have been made in a folder-gluer.

A process and device for filling a container or carton with flat blanks, such as folded box blanks, has had several embodiments which are disclosed by Swiss Pat. No. 630,860, French Pat. No. 2,341,508 and U.S. Pat. No. 4,241,559. As disclosed in the Swiss patent, a stack of the box blanks are piled into a container to be on an edge of the box blank and the container is shifted during the piling-up of the blanks in the container. It is also possible to control the shifting of the container as the blanks are piled therein by the thickness of the blanks, which are being piled up as disclosed by the French patent. It has been proposed to continuously and regularly shift the container. This proposal certainly suits an uninterrupted piling-up of the sheets but could not be appropriate for the piling-up of a predetermined number of flat elements with several plies or thicknesses such as found with folded box blanks.

The above-mentioned devices have amongst other things the drawback not to be continuously checked with regard to the arriving sheets. On the other hand, in both of the above-mentioned cases, the shifting of the container occurs through the piling-up of the elements. It is therefore obvious that the shifting of the container which has one or two piles of piled-up elements will be shifted more easily than one that has had many more piles or layers of elements. The force acting on the filling device will increase and might disturb its operation. Moreover, as the operator constantly moves from the location of the empty container to a location of the full container which is to be removed, the known devices are inconvenient.

SUMMARY OF THE INVENTION

The present invention is directed to a method and device for controlling the filling of a container in order to overcome the above-mentioned drawbacks. To accomplish these aims, the present invention is directed to a device for filling a container with a sheet-like blank, said device comprising a frame; a container support table mounted for movement on the frame; means for shifting the table in said frame; means for loading containers onto the table and removing containers therefrom; said frame supporting means for creating a flow of shingled blanks including means for detecting the height of the flow of shingled blanks; feed means on the frame for removing a blank one at a time from said shingled flow including a first motor for operating the feed means; filling means for inserting the blanks one after another into the container on said table; conveyor means on the frame for receiving the removed blanks from the feed means and transporting the removed blanks one after another to the filling means, said conveyor means including a second motor for operating the conveyor means; said filling means including first sensing means for determining the presence of a blank in the conveyor means, and second sensing means for detecting a surface in the container for receiving the blanks which surface may either be a bottom of the container or a layer of blanks already received in the container; said means for shifting the table including a pump driven by the second motor, said pump having means for setting the flow of the pump in response to the thickness of the blanks being handled; and means for raising and lowering the filling means with the second sensing means stopping insertion of the filling means when a surface in the container is detected. Preferably the filling means includes third sensor means for determining a side wall of the container.

The method for operating the apparatus is that the means for detecting the height of the flow of blanks in a shingled relationship causes the first and second motors to operate to drive the feed means, the conveyor means and the pump respectively. The first, second and third sensing means of the filling means control the lowering of the filling means into a container and also the shifting of the container relative to the filling means so that shifting does not begin until blanks reach the filling means for insertion into the container.

Other objects and advantages of the present invention will be apparent from the following description and drawings.

DESCRIPTION OF THE PREFERRED EMBODIMENTS

Figure 1:
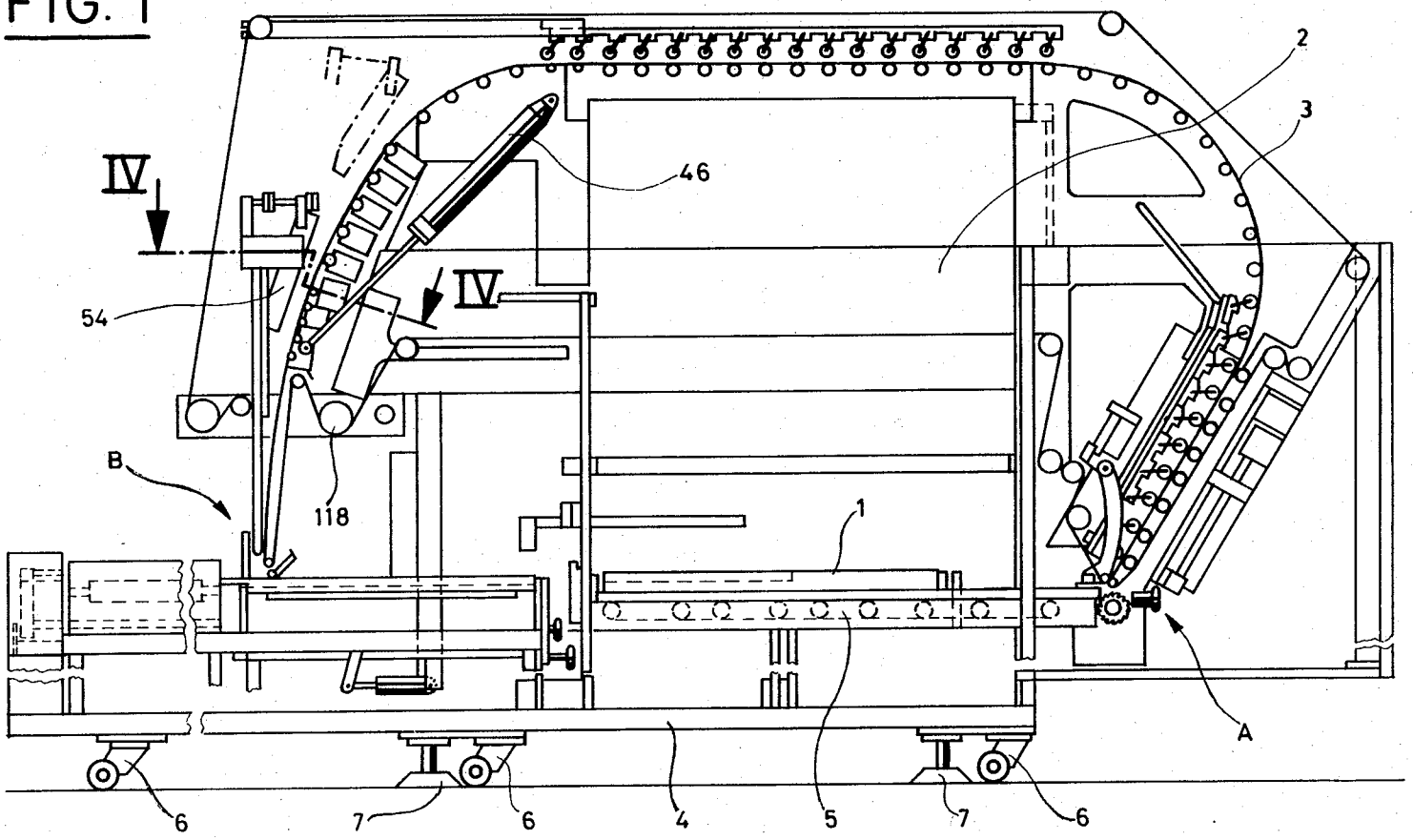
FIG. 1 is a schematic side view of the device in accordance with the present invention taken from line I—I of FIG. 2.
Figure 2:
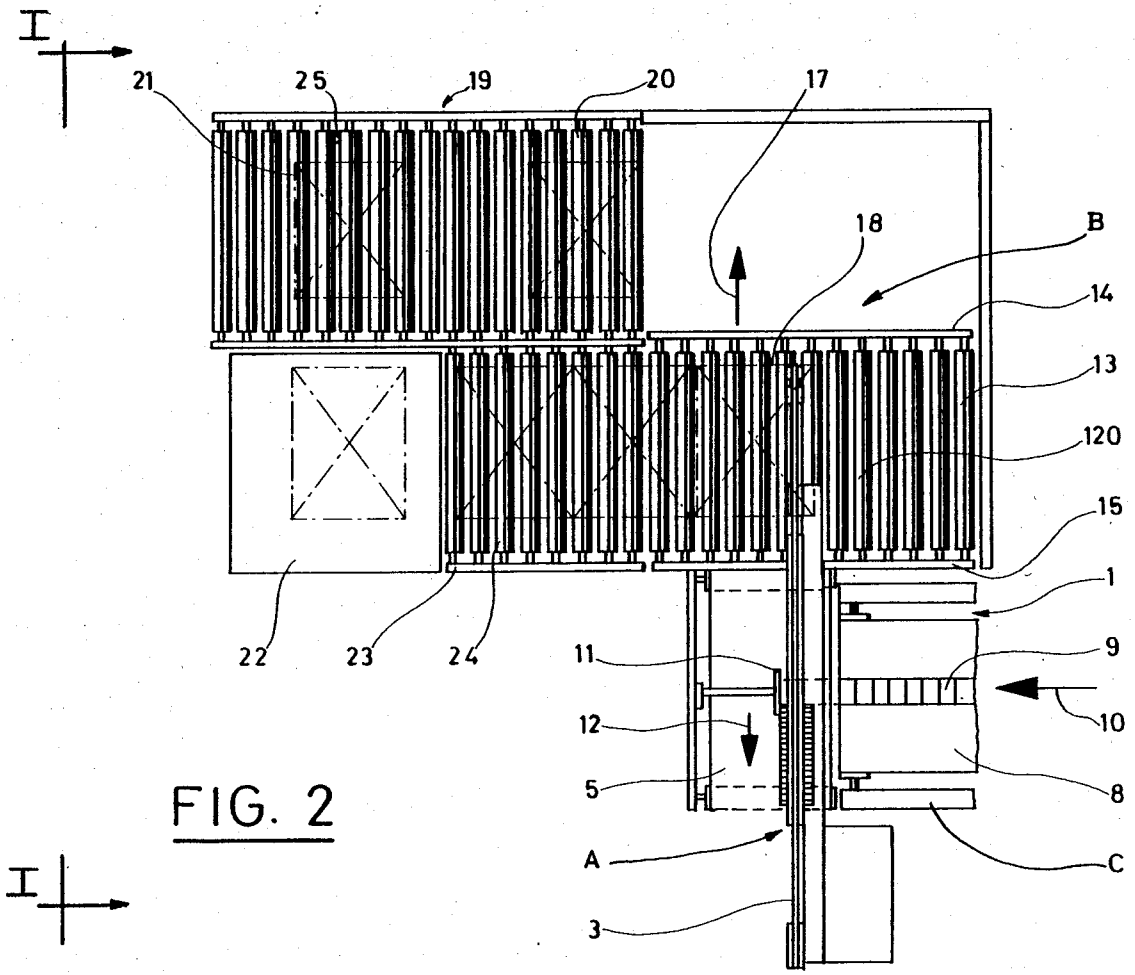
FIG. 2 is a plan view of the device of FIG. 1.

The device of the present invention is illustrated in FIGS. 1 and 2 as being located at a delivery end of a folder-gluer 1. The device has a frame 2 (FIG. 1) supporting a box blank conveyor means 3 which receives boxes from a feed means or station A and transports them to a filling means or station B. The frame 2 is mounted on a base 4 supporting a belt conveyor 5 which extends perpendicular to the medium axis of the folder-gluer 1. The filling means or station B is also mounted on the base member 4 and the belt conveyor 5 is driven by friction from the last roller forward of the delivery station of the folder-gluer. This allows an easy connection between the folder-gluer and the filling station. The base member 4 is provided with rollers 6 and a brake 7 which enables easy positioning of the device at a delivery station of the folder-gluer 1.

As best illustrated in FIG. 2, the folder-gluer 1 has a delivery station C with a belt 8 on which a flow of folded box blanks 9 are traveling in the direction of arrow 10. As the flow moves onto the conveyor belt 5, it engages a stop 11 so that the flow then moves in the direction of arrow 12 which is approximately at right angles to the direction 10. The conveyor belt 5 carries the blanks 12 to the feed means or station A. The folded box blanks 9 are then transferred from the feed station or means A by the box conveyor 3 to the filling means or station B.

At the filling means or station B, the frame supports a roller or container support table 120, which has a plurality of rollers 13 mounted between two lateral cheeks or plates 14 and 15. The container support table is mounted in the base 4 (FIG. 1) to be shifted by shifting means such as a hydraulic piston 16 (FIG. 8) in the direction of arrow 17 (FIG. 2) so that when the folded box blanks 9 arrive to be inserted into a container or carton 18, which is illustrated in FIG. 2 in broken lines, they can be applied in a stack with the blanks on edge. The table 120 will include means for holding the container 18 in a fixed position on the rollers 13. After the container 18 has had at least the entire layer filled, table 120 is shifted in a direction of arrow 17 to be aligned with a removed or second conveyor 19 which has rollers 20. Both the rollers 13 of the table 120 as well as the rollers 20 of the conveyor 19 are driven and set into motion so as to carry container 18 from the table 120 onto the conveyor 19. Once the container is on the conveyor 19, it is moved to the position of the container 21 where it is engaged by pusher 25 that is actuated by a hydraulic piston (not illustrated) to be shifted onto a table 22. At the table 22, the container can either be removed or if a second layer of box blanks is to be inserted, placed on a third or loading conveyor 23 with rollers 24 to be fed back to the table 120.

Figure 3:
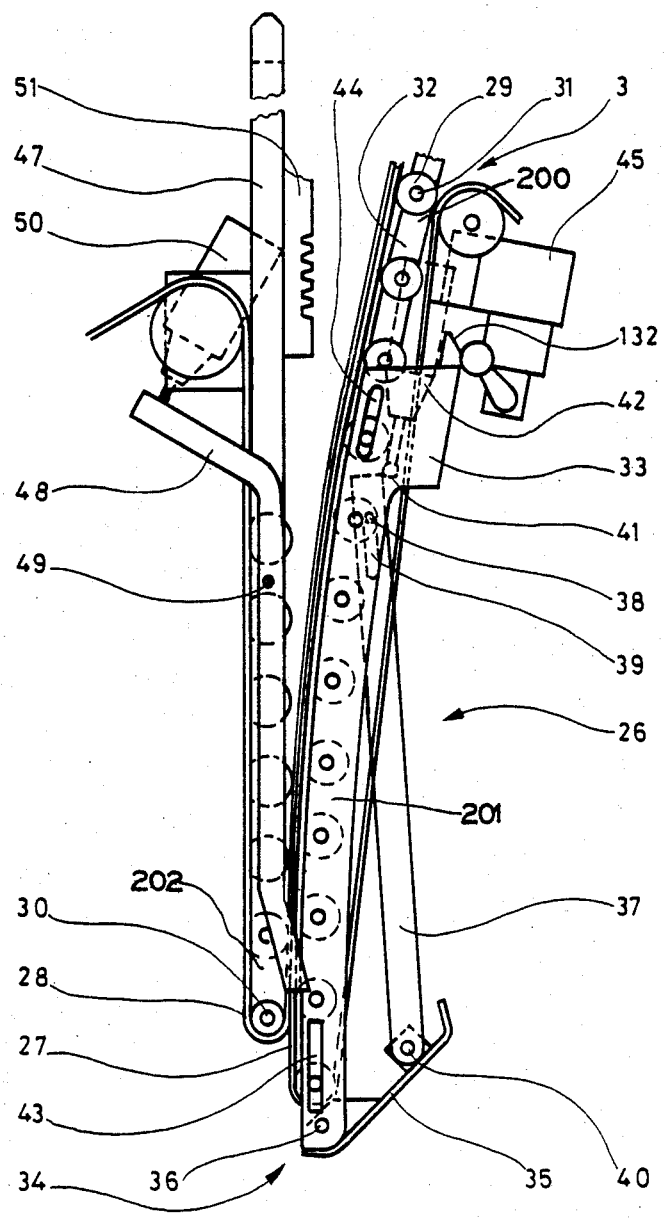
FIG. 3 is a detailed side view of a filling unit of the device of the present invention.

The filling means B has an end unit generally indicated at 26 in FIG. 3. The end unit 26 is arranged at one end of the box blank conveyor 3, which conveyor has opposed endless belts 27 and 28. As illustrated, the endless belt 27 is guided on rollers 29 while the endless belt 28 is guided on rollers such as 30. The rollers 29 are supported by axles 31 in a frame 200 having lateral cheeks or plates 32. A subframe 201 having lateral cheeks or plates 33 is mounted for movement on the frame 200. The subframe with the cheeks 33 at a lower end generally indicated at 34 is provided with a plate or shutter 35 which is pivoted to the cheeks 34 by a pivot pin or axle 36. The shutter 35 is also connected to the cheeks 33 by a link or lever 37. The link or lever 37 is connected to the cheek 33 by a lost motion connection formed by a pin 38 received in a slot 39 formed in the link 37. The other end of the link 37 is connected to the shutter 35 by an axle 40. An upper end of the link or arm 37 will engage a prong or feeler 41 of a hydraulic valve 42. Thus, movement of the shutter 35 to pivot around the pin 36 is detected by the hydraulic valve which as discussed hereinafter can interrupt the shifting of the carriage 120 and stop the delivery of boxes by stopping the drives for belts 27 and 28.

The subframe 201 can move vertically relative to the frame 200. As illustrated, the cheeks 33 have elongated slots 43 and 44 which receive axles of rollers such as 29 and allow shifting of the subframe 201 relative to the member 32. Thus, when the lower end or extremity 34 meets an obstacle such as a bottom of a container 18 or the top of a layer of folded boxes, it shifts and by means of a cam 132 acting on a hydraulic valve 45 will stop a downstroke of the filling means. The descending motion of the filling unit 26 is caused by a hydraulic piston 46 (FIG. 1) which shifts the filling means B relative to the frame 2.

The filling unit 26 also includes a subframe 202 having an arm 47 supporting the axles for the rollers 30 of the continuous belt 28. A detecting lever 48 is pivotally mounted on the arm or member 47 by a pivot pin or axle 49. A lower end of the lever 48 lies in the path of the elements being transported by the continuous belts 27 and 28 and an upper end acts on a hydraulic valve 50 controlling the shifting of the table 120 that supports the container 18. The arm 47 is also provided with a toothed track or rack 51 which is engaged by a pinion 52 (see FIG. 4). These two elements enable setting the distance between the lower end of the belt 28 relative to the lower end of the belt 27 when handling folded boxes of different sizes.

The coaction of the arm 48 with the hydraulic valve 50 forms a first sensor for detecting the box blanks between the belts. The coaction of the cam 132 with the hydraulic valve 45 forms a second sensor for detecting a surface on which the box blanks are being stacked and the coaction of the end of the link 37 with the probe 41 of the valve 42 forms a third sensing means for detecting a side wall 127 (FIG. 8) of the container 18.

Figure 4:
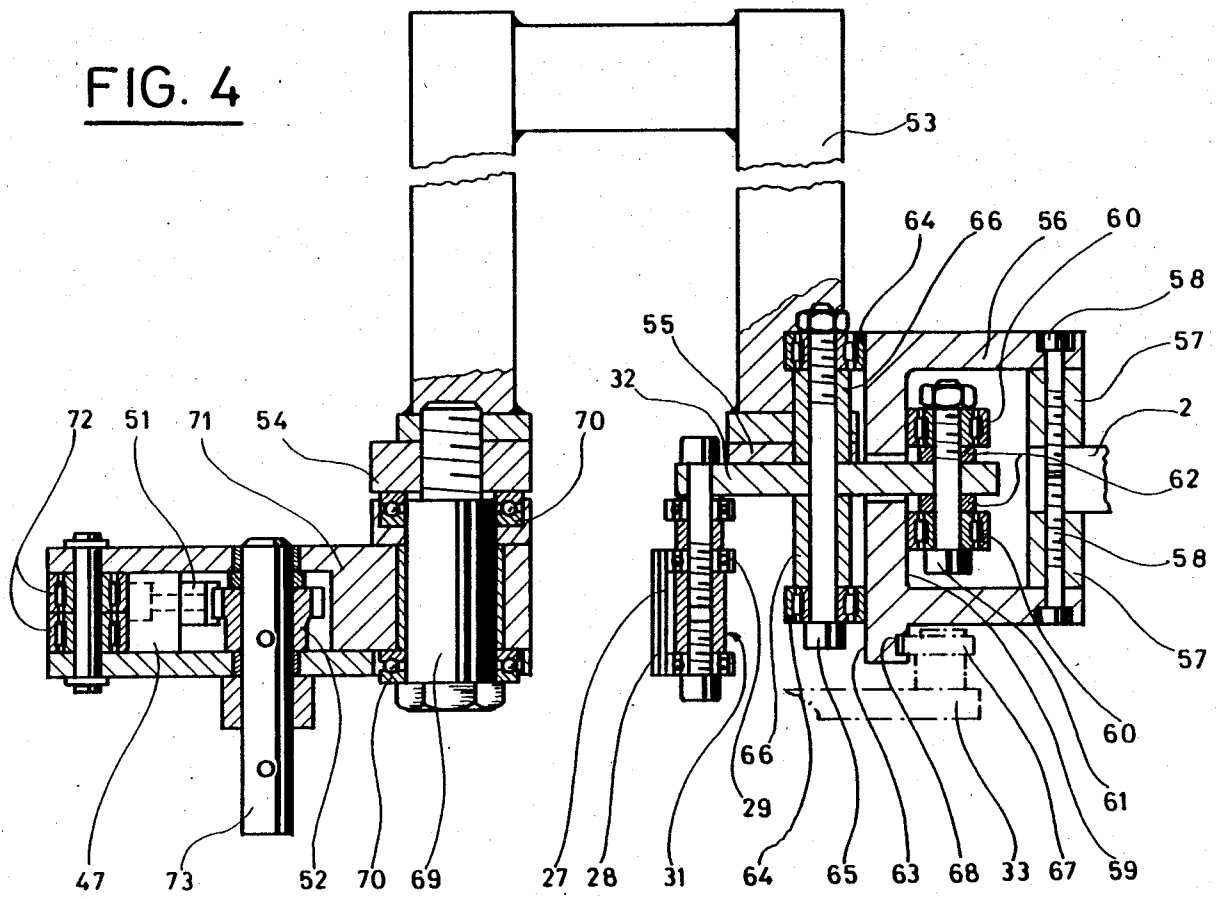
FIG. 4 is a partial cross-sectional view taken along lines IV—IV of FIG. 1.

The construction of the box blank conveyor 3 at the location of the filling unit 26 is best illustrated in FIG. 4. A stirrup 53 is mounted with screws against a frame of the conveyor 3, for example, against an extension of it which is composed of a plate 55 secured to the cheek member or plate 32. A U-shaped rail or channel 56 is connected to the frame 2 by cross-pieces 57 receiving screws 58. An inner face 59 of the U-shaped arrangement 56 acts as a path or track for rollers 60 which are mounted onto the lateral cheek 32 by an arrangement including a bolt 61 and spacers 62. The lateral cheek 32 extends through the bottom of the U-shaped arrangement 56. An outer surface 63 of the U-shaped arrangement 56 acts as path for rollers 64 which also are attached to the lateral cheek 32 by an arrangement including a bolt 65 and cross-pieces or spacers 66. This arrangement secures and guides the filling unit 26 on the main frame 2. The cheek or plate 33 of the subframe 201 which is shown in dotted lines is guided by a roller 67 running on a path in a groove 68 on the rail unit 56.

The other arm of the stirrup 53 is connected to a support 54. A pin 69 with two thrust bearings 70 is secured to the support 54 and supports a lever 71 which supports the arm 47 for sliding movement against a bearing roller arrangement 72. In addition, the lever 71 supports the pinion 52 which engages the rack 51. The pinion 52 is mounted on an axle 72 which is provided with a setting handle which is not illustrated.

Figure 5:
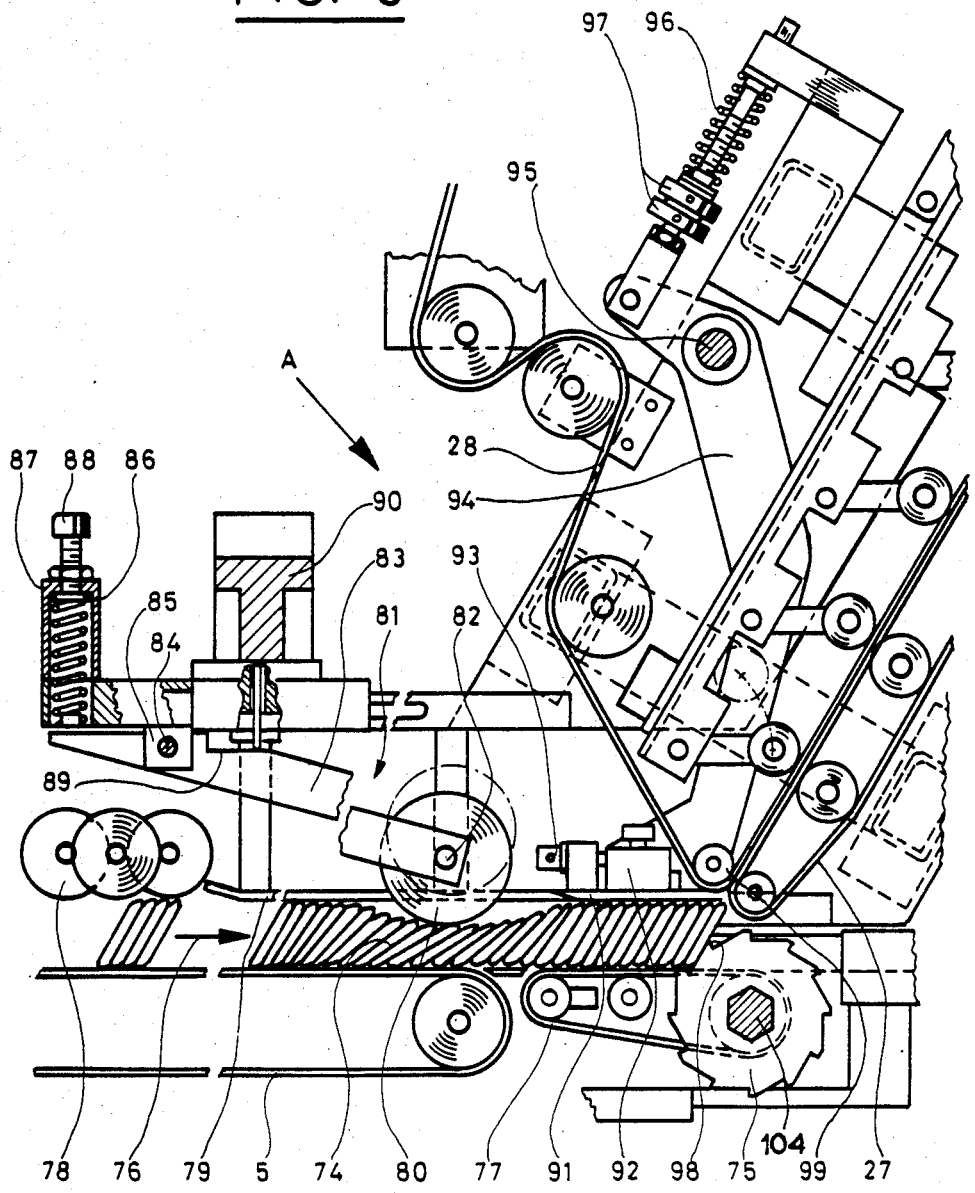
FIG. 5 is an enlarged detail side view with portions broken away for purposes of illustration of a unit for creating a flow of blanks in a shingled relationship and the feeding unit.

As mentioned hereinbefore, the flow of box blanks 9 are received on the conveyor 5 and conveyed towards a feed means or unit A. As illustrated in FIG. 5, the boxes are moved in a flow or stack with a shingled relationship in a direction of arrow 76. This flow of folded boxes 74 is transported to a ratchet wheel 75 by a takeover conveyor 77. During this run, the advance of the flow is held up by pressure rollers 78 as well as an upper guide 79. The upper guide 79 has a slot into which a wheel 80 of a flow detector 81 is received. The wheel 80 is mounted on an axle 82 at one end of a lever 83 which is pivotally mounted by an axle 84 to a support or member 85 of the frame. The other or free end of the lever 83 engages a spring 86, which is in a bell-shaped spring housing 87 fixed on the support 85. The compression force of the spring 86 can be adjusted with a screw 88. Adjacent the pivot point 84, the lever 83 has a bearing or flat surface 89 which receives a sensor or probe of a sensor 90. It is noted that this sensor 90 can be hydraulic sensor, a potentiometer or an analogic proximity detector which will transmit information of the vertical shifting of the lever 83. The movement of the lever based on the wheel engaging the stack or flow 74 forms a flow detector 81 which will detect the height of the flow of the stack of box blanks arranged in a shingled relationship.

A shiftable gauge or gate 91 is supported by a stud 92 and engages the upper edges of the flow 74 of folded boxes as they approach the ratchet wheel 75 and a mouth which is formed by the belts 27 and 28 of the conveyor 3. The position of the shiftable gate 91 is set with a setting screw 93. The stud 92 is connected to a lever 94, which is pivoted around an axle 95. This lever 94 is biased in a counterclockwise direction by an arrangement comprising the spring 96 with settable elements 97. When the ratchet wheel 75 rotates, the first box 98 of the flow 74 is introduced into the mouth between the belts 27 and 28. The belt 28 running around the roller 99, which is mounted on the lever 94, will thus be pushed upwardly or away from the belt 27 by the first box 98. This causes a pivoting of the lever 94 in a clockwise direction and a backward shifting of the gauge or gate 91 previously set according to the thickness of the blank. Thus, the taking-up of a second box with the first one is prevented and creates a flow of boxes of one box after another in the conveyor 3 with a regularity which is determined by the pitch of the teeth of the ratchet wheel 75. The shiftable gate 91 is also provided with a fixed stop setting with a position depending on the thickness of the box to be processed.

Figure 6:
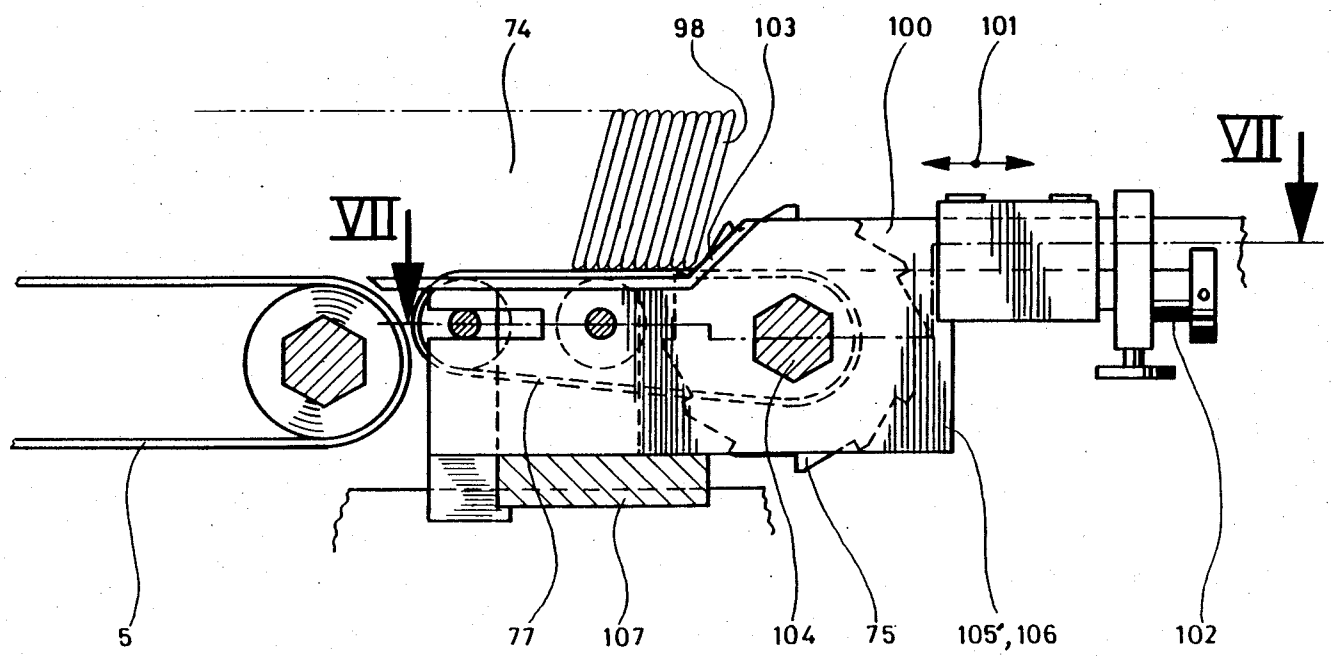
FIG. 6 is an enlarged detail view of the feeding unit.
Figure 7:
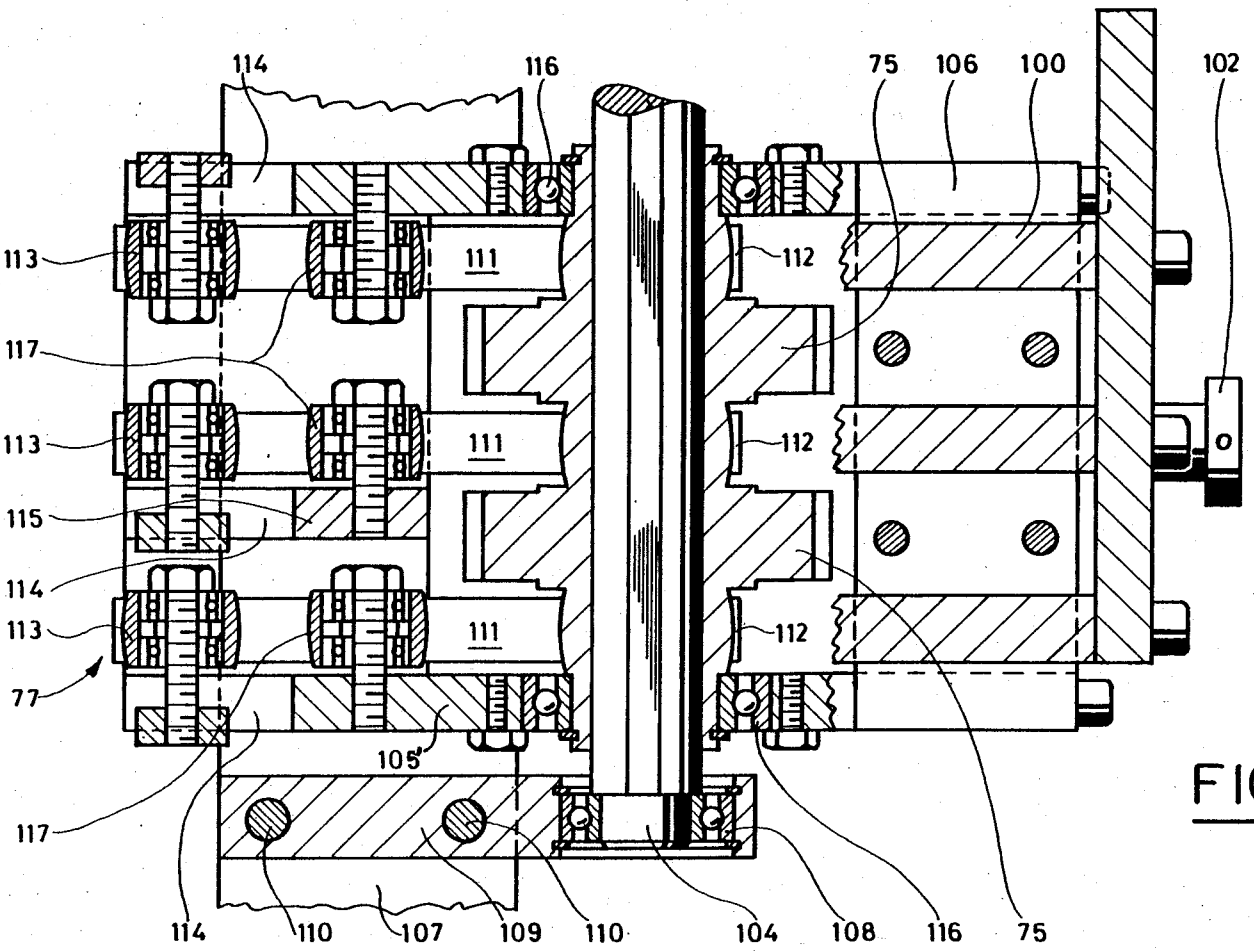
FIG. 7 is a cross-sectional view with portions in elevation for purposes of illustration taken along lines VII—VII of FIG. 6.

A more detailed view of the operation of the feeding means is illustrated in FIGS. 6 and 7. In particular, it includes a device for controlling the taking-up of the first box 98 of the flow by the ratchet wheel 75. To make sure that only the first box 98 is introduced into the mouth of the conveyor, the depth of the tooth of the ratchet wheel is set according to the thickness of the folded box blank. Therefore, a fork 100 which is shiftable along the direction of the double arrow 101 by a setting screw 102, is provided. In the illustrated execution in FIGS. 6 and 7, two ratchet wheels 75 are provided side-by-side and the fork 100 engages on each side of these ratchet wheels. Thus, if the fork 100 with the stop surfaces 103 move to the left (FIG. 6), the distance between the edge of the tooth and the stop surface or nose 103 is reduced. By moving the fork 100 back to the right, the distance between the edge of the tooth and the stop surface 103 is increased to process a folded box blank with a greater thickness. The ratchet wheels 75 are mounted on a hexagonal axle 104 driven by a hydraulic motor 105 (see FIG. 8). The ratchet wheels are supported for rotation by roller bearings 116 and two walls 105 and 106 which are resting on a cross-beam 107 (see FIG. 7).

As best illustrated in FIG. 7, a free end of the hexagonal axis 104 is supported in a bearing 108 of a frame member 109, which is mounted on the cross-beam 107 by screws 110. The two ratchet wheels 75 have three pulleys 112 for three belts 111 of the takeover conveyor 77, which are arranged with a belt 111 on each side of each wheel. These belts also run around tension pulleys 113, which have axles that can be shifted along a groove 114 in both walls 105 and 106 and in a support 115. The belts 111 are also resting on pulleys 117.

Figure 8:
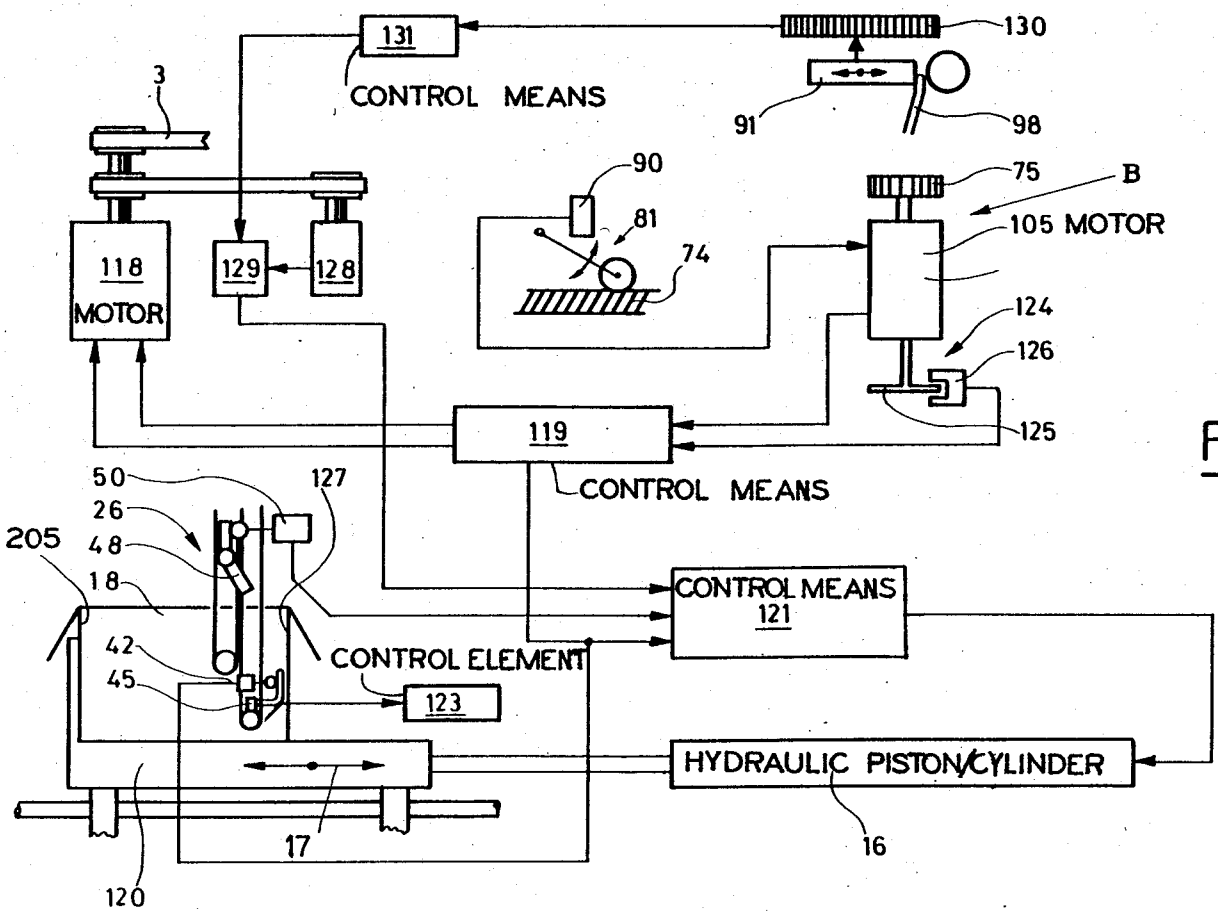
FIG. 8 is a schematic view illustrating a control circuit for the device of the present invention.

The operation of the various units or stations of the device for filling a container can be best understood when referring to FIG. 8. First, the height of the flow of box blanks 74 arriving from the folder-gluer is determined by a flow detector 81. The hydraulic sensor 90 which opens more or less with regard to the height of the flow will control the oil flow of the hydraulic motor 105 which rotates the ratchet wheels 75 of the feed means. The motor 105 thus operates at a speed depending on the opening of the sensor 90, i.e., on the height of the flow of box blanks. Of course, a lower and an upper limit of the flow height can be determined. As soon as the flow detector 81 starts its operation, the filling unit 26 will be inserted into a container 18 which is located at the filling station. The second sensor formed by the hydraulic valve 45 acting through a control element 123 controls the flow of the fluid to the cylinder 46 to control the downstroke of the filling unit 26. Once the second sensor formed by the valve 45 engages the lower surface, whether its the bottom of the carton or container 18 or an upper surface of a previously applied layer of box blanks, it stops the flow to the cylinder 46 to terminate the downward stroke.

A hydraulic motor 118, which is a second motor, drives the conveyor means 3 when it is actuated by a control element or means 119. The rate of rotation of the second motor 118 is regulated with the rate of rotation of the first motor 105. Thus, with the first motor 105 and the second motor 118 driving the respective feed means and conveyor means, the box blanks will start to be fed into the conveyor means and be conveyed by the conveyor means one after another. As the box blanks are transported to the filling unit 26, their presence will be indicated or sensed by a detecting lever 48 of the first sensor which causes the hydraulic valve 50 to supply fluid to a control means 121 which control the actuation of the cylinder 116 for movement of the carriage or support table 120 in the frame of the device. It should be noted that as a stack is beginning to be placed, the filling unit 126 is placed in the carton and the table 120 is adjusted so that a front wall 205 of the carton is adjacent the filling unit 26. As the stack begins to be applied, which is indicated by the first sensor detecting the passage of the first blank into the filling unit, the hydraulic cylinder 16 moves the carriage 120 from right to left as illustrated in FIG. 8 so that the folded box blanks are placed one after another in a stack with the first deposited blank being positioned against the wall 205. This movement will continue either until a predetermined number of box blanks has been deposited in the stack or until the third sensing means with the valve 42 is actuated by the shutter 35 coming in contact and being pivoted by a back wall 127 of the container or carton 18. When this occurs, the valve 42 supplies a signal to the control means 121 to stop the continued movement of the carriage or table 120.

The rate of advance for the table 120 and thus the rate of shifting the carton 18 as it is being filled is set based on the thickness of the box blank or the sheet-like element being handled. Thus, the hydraulic piston or cylinder 16 receives oil from a pump 128 which is driven by the second motor 118 of the conveyor means. Since the thickness of the boxes or box blanks can change from one job to another, the flow of the pump 128 is adjustable and this is accomplished in the following manner. A detector 130 senses the position of the shiftable gate or gauge 91 of the feed means or station A. The output of the detector 130 is supplied to a control means 131 for setting a flow control unit 129 for the pump 128. Thus, the rate of flow from the pump 128 is controlled based on the particular thickness of the blank or element being processed.

As mentioned hereinabove, the device can operate to apply a predetermined number of box blanks or elements in the stack. The predetermined number for a row or stack can be obtained by a counting device 124 secured on the shaft 104 of the ratchet wheel 75. As is apparent, one rotation of the shaft 104 will feed a number of blanks equal to the number of teeth of the ratchet wheel 75. Thus, the counting device 124 can use a disk 125 on either the end of the shaft 104 or rotated at a speed corresponding to the speed of rotation for the shaft 104. An impulse detector 126 will detect the passage of a notch in the disk 125. As soon as the number of impulses suits the requested number of boxes or blanks, the control means 119, which receives an output signal of the counter 124, can apply a command signal to the first and second motors. At this command signal, the first motor 105 immediately stops while the motor 118 accelerates to empty the box blanks in the conveyor 3. The detecting lever 48 of the first sensor will detect when the last blank in the conveyor 3 has been discharged through the filling unit 26 and this signal is received by the control means 121. At this time, the control means 121 will cause a lifting of the filling unit 26 and then a lateral shifting of the carton 18 on the table 120 to enable applying the next row or stack therein. When the desired number of rows or stacks have been placed in the carton, the filling unit 26 is completely removed and the carton is then removed by having the table 120 aligned with the conveyor 19 (FIG. 2). Then the conveyor 19 receives the carton and moves it to a position to be moved by the pusher 25 onto the table 22 where it is either completely removed from the device or returned for receiving a second layer of rows.

If the device is operated to fill each row, then the third sensor means engaging the rear or back wall 127 will cause a stopping of the feed means and the filling means. Then the control means 121 will cause a lifting of the filling unit 26 and shifting of the carton either to receive another row or to be removed from the filling station B.

It should be noted that all of the hydraulic elements in this device can be replaced by corresponding electrical or pneumatic devices. The present invention achieves a secure filling of the containers with folded boxes and the arrangment of the various units enables the operator to constantly watch the operation of the station processing the folded box blanks.

Although various minor modifications may be suggested by those versed in the art, it should be understood that I wish to embody within the scope of the patent granted hereon, all such modifications as reasonably and properly come within the scope of my contribution to the art.

I claim:

1. A device for filling a container with sheet-like blanks, said device comprising a frame; a container support table mounted for movement on the frame; means for shifting the table in said frame; means for loading containers onto the table and removing container therefrom; means in the frame for creating a flow of shingled blanks including means for detecting a height of the flow of shingled blanks; feed means on the frame for removing a blank one at a time from said shingled flow including a first motor for operating the feed means; filling means for inserting the blanks one after another into the container on said table; conveyor means on the frame for receiving the removed blanks from the feed means and transporting the removed blanks one after another to the filling means; said conveyor means including a second motor for operating the conveyor means; said filling means including first sensing means for determining the presence of a blank in the conveyor means, and second sensing means for detecting an interior surface of the container for receiving the blank; said means for shifting the table including a pump driven by the second motor, said pump having means for setting a flow of the pump according to the thickness of the blanks being handled; and means for raising and lowering the filling means with the second sensing means stopping the lowering of the filling means when said surface in the container is detected.

2. A device according to claim 1, wherein the means for detecting a height of the flow of shingled blanks includes a pivoting lever provided with a wheel at one end resting on an upper surface of the flow, said lever having a pressure surface and converting means for engaging the pressure surface and converting the pivotal movement of the lever into information regarding the height of the flow.

3. A device according to claim 2, wherein the converting means includes a hydraulic sensor.

4. A device according to claim 2, wherein the converting means comprises a potentiometer.

5. A device according to claim 2, wherein the converting means includes an analogic proximity detector.

6. A device according to claim 1, wherein the feed means includes at least one ratchet wheel being driven by the first motor and cooperating with both a shiftable stop and a shiftable gate positioned near a mouth of the conveyor means, said shiftable gate being mounted on a lever mounted for pivotable movement, said conveyor means including oppositely facing belts driven by the second motor with one belt of the conveyor means running over a roller mounted for rotation on said lever.

7. A device according to claim 1, wherein the second sensing means includes a subframe mounted on the frame of the conveyor means for slidable movement at the filling means, said subframe moving between a first and second position with the second position causing a hydraulic valve to be actuated when a surface is detected to stop lowering of the filling means into a carton, said filling means including third sensing means for detecting a side wall of the carton and including a shutter mounted on said subframe for pivotal movement and being connected to the subframe by a link, the upper end of the link adjacent the subframe actuating a hydraulic valve when the shutter engages and is pivoted by a side wall of the container, said valve indicating the completion of the formation of the stack; and the first sensing means including an arm mounted for pivotal movement on a frame of the filling means between a first position with a portion extending across the path of the conveyor means and a second position removed from the path, said arm acting on a valve means for applying a signal to a control means for the means shifting the table in said frame.

8. A device according to claim 1, wherein the means for setting the flow of the pump in response to the thickness of the blanks being handled includes a position detector for a shiftable gate of the feed means, said position detector transmitting information to a control means for setting the flow of the pump.

9. A device according to claim 1, wherein the means for loading and removing containers includes a first roller conveyor mounted in line with the table when in a position beneath the filling means, a second roller conveyor mounted in alignment with a second position of the support table when moved out from beneath the filling means, pusher means positioned along the second roller conveyor for transporting a container from the second roller conveyor to a fixed table aligned with the first roller conveyor.

10. A device according to claim 1, wherein the filling means includes a third sensing means for determining the position of a side wall of the container, said third sensing means when actuated causing the stopping of the application of blanks into that stack.

11. A method for controlling the filling of a container with a stack of sheet-like blanks comprising providing a device having means for creating a flow of shingled blanks, feed means for removing a blank one at a time from the flow of shingled blanks, filling means for inserting the blanks one after another into a container, conveyor means for receiving the removed blanks from the feed means and transporting the removed blanks one after another to the filling means and means for shifting a container relative to the filling means as blanks are inserted therein; determining the presence of a flow of shingled blanks at the feed means; starting the feed means and the conveyor means simultaneously to feed blanks from the flow of shingled blanks one after another and one at a time into the filling means; detecting the vertical and longitudinal positions of the filling means relative to a surface in the container; lowering the filling means and stopping the lowering of the filling means in response to the detecting of a preselected vertical position; detecting the arrival of the blank from the conveyor means to the filling means; inserting the blanks one after another and one at a time into the container on their edges in a stack while actuating the means for shifting the container as each blank is placed therein; and then selectively detecting one of the completing of the filling of a row by the detected longitudinal position of the filling means and the feeding of a predetermined number of blanks to stop the filling operation.

12. A method according to claim 11, wherein the step of selectively detecting detects the predetermined number of blanks fed by the feed means, stopping the feed means while continuing the operation of the conveyor means to fill the blanks being transported therein and then removing the filling means from the container.

13. A method according to claim 11, wherein the step of selectively detecting determines the filling of the row and immediately stops the operation of the feed means, the conveyor means and initiates the elevation of the filling means from the filling position in the container.

* * * * *